US005254901A

United States Patent [19]

Haraden et al.

[11] Patent Number: 5,254,901

[45] Date of Patent: Oct. 19, 1993

[54] NECK EXTENDER FOR A REFLECTOR LAMP

[75] Inventors: Thomas Haraden, S. Hamilton; Harold L. Hough, Beverly; Peter Gagnon, Topsfield, all of Mass.

[73] Assignee: GTE Products Corporation, Danvers, Mass.

[21] Appl. No.: 814,333

[22] Filed: Dec. 26, 1991

[51] Int. Cl.[5] ..... H01J 1/32

[52] U.S. Cl. ..... 313/113; 313/315; 313/318; 362/296

[58] Field of Search ..... 313/113, 318, 634, 636, 313/242, 315; 362/296, 307, 310, 341

[56] References Cited

U.S. PATENT DOCUMENTS

| | | | |
|---|---|---|---|
| 4,807,099 | 2/1989 | Zelin | 362/296 X |
| 5,016,150 | 5/1991 | Gordin et al. | 362/296 X |
| 5,079,474 | 1/1992 | Holten | 313/113 |

*Primary Examiner*—Donald J. Yusko
*Assistant Examiner*—Ashok Patel
*Attorney, Agent, or Firm*—Joseph S. Romanow; Carlo S. Bessone

[57] ABSTRACT

A reflector lamp includes a temperature resistant, plastic, tubular neck extender. The neck extender is disposed between a reflector and a base and is attached to the reflector and the base. The extender can be attached to the reflector by clamping eyelets or, alternatively, by an adhesive. The resulting lamp can be used in recessed lighting fixtures.

13 Claims, 3 Drawing Sheets

NECK EXTENDER FOR A REFLECTOR LAMP

FIELD OF THE INVENTION

This invention relates to a neck extender for a reflector lamp and, more particularly, to a temperature resistant, tubular neck extender for a reflector lamp.

BACKGROUND OF THE INVENTION

Reflector lamps include a lens, a reflector, a lamp inside the reflector and a metal base with threads for engaging a lighting fixture socket. A typical reflector lamp is illustrated in FIG. 1. A reflector lamp 100 includes a lens 102, a reflector 101, and a base 108. Also included are a lamp capsule 103, leads 112 and 113, hollow eyelets 104 and 105, and electrical conductors 106 and 107. Lens 102 can be adhesively bonded to reflector 101. Lamp capsule 103 may be any conventional lamp, including a filament lamp or an arc tube, that generates light in response to electrical energy carried by leads 112 and 113. Leads 112 and 113 can be soldered or welded to brass eyelets 104 and 105. Electrical conductors 106 and 107 are soldered to leads 112 and 113, respectively. Electrical conductor 106 is soldered to the center conductor of base 108, and electrical conductor 107 is welded or soldered to the outer conductor of base 108. Electrical conductors 106 and 107 carry electrical energy from base 108 (as supplied by the lighting fixture socket) to leads 112 and 113. Base 108 can be attached to reflector 101 through the use of dimples (not shown) within base 108 which engage mating holes in reflector 101. This method of attachment is referred to as "dimpling". Base 108 can also be attached to reflector 101 with an adhesive, alone or in combination with dimpling.

It has become desirable to use reflector lamps in lighting fixtures having a socket that is recessed within the fixture. A conventional reflector lamp, such as the one illustrated in FIG. 1, does not fit into some recessed lighting fixtures, including ones which are conical in shape. In order to utilize a conventional reflector lamp with recessed lighting fixtures, modular extenders have been designed and manufactured to extend the lamp base. These modular extenders include a female threaded socket on one end and a male base with screw threads on the other end. Currently available modular extenders are cylindrical in shape and can be installed in a socket of a recessed lighting fixture. A conventional reflector lamp can then be installed in the modular extender female socket. Drawbacks associated with this solution include high tooling costs and high parts costs involved in the manufacture of the modular extender. Another more serious drawback associated with the use of this modular extender is that it is unsafe to install the modular extender in an existing fixture. A person installing the modular extender may receive an electrical shock if the socket is energized and the person touches the inside portion of the female socket of the modular extender.

It is an object of the present invention to provide a new and improved reflector lamp adapted for use in recessed lighting fixtures.

It is another object of the present invention to provide a new and improved reflector lamp with an extended neck for use in recessed lighting fixtures.

It is yet another object of the present invention to provide a reflector lamp with an extended neck for use in recessed lighting fixtures, which can be manufactured relatively inexpensively.

SUMMARY OF THE INVENTION

According to the present invention, these and other objects and advantages are achieved in a reflector lamp including a lens, a reflector attached to the lens and having a neck, and a base for connection to a lighting fixture socket. The lamp further includes means internal to the reflector for generating light in response to electrical energy, and extender means connected between the reflector and the base for extending the neck of the reflector. The extender means comprises a single electrically insulating member directly connected to the neck of the reflector.

In a preferred embodiment of the present invention, the extender means has an endwall clamped to the reflector by eyelets. In an alternate embodiment of the present invention, the extender means is attached to the reflector by an adhesive material.

BRIEF DESCRIPTION OF THE DRAWINGS

Numerous other objects, features and advantages of the invention will become apparent upon a reading of the following detailed description taken in conjunction with the accompanying drawings, in which.

DETAILED DESCRIPTION OF THE INVENTION

Figure 1:
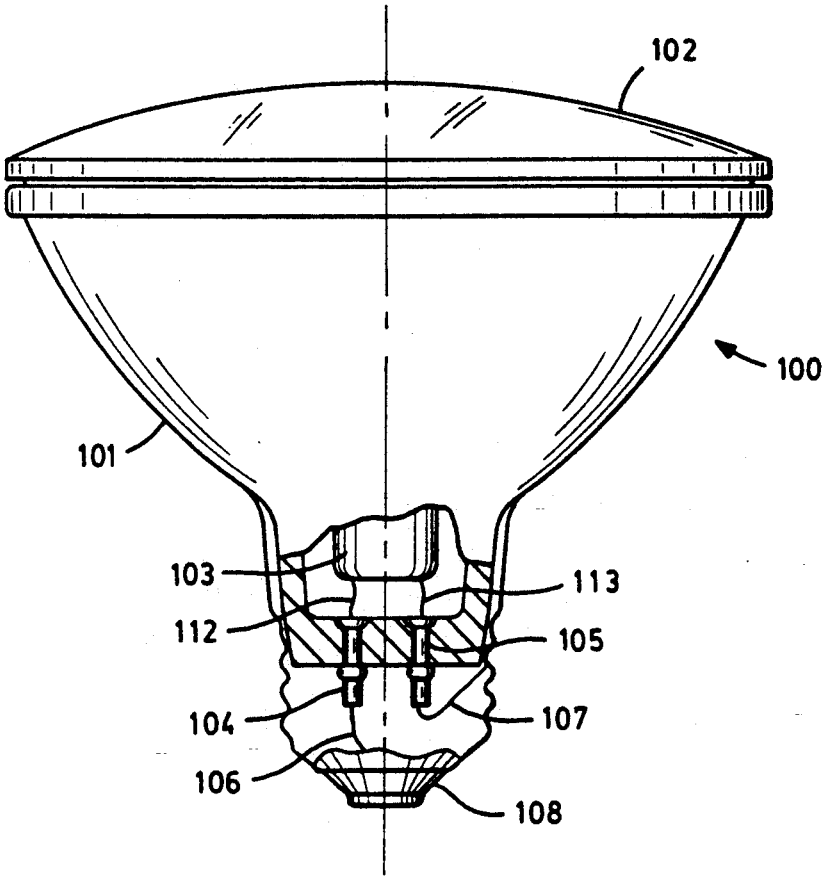
PRIOR ART FIG. 1
FIG. 1 is a partially cut away side view of a prior art reflector lamp.
Figure 2:
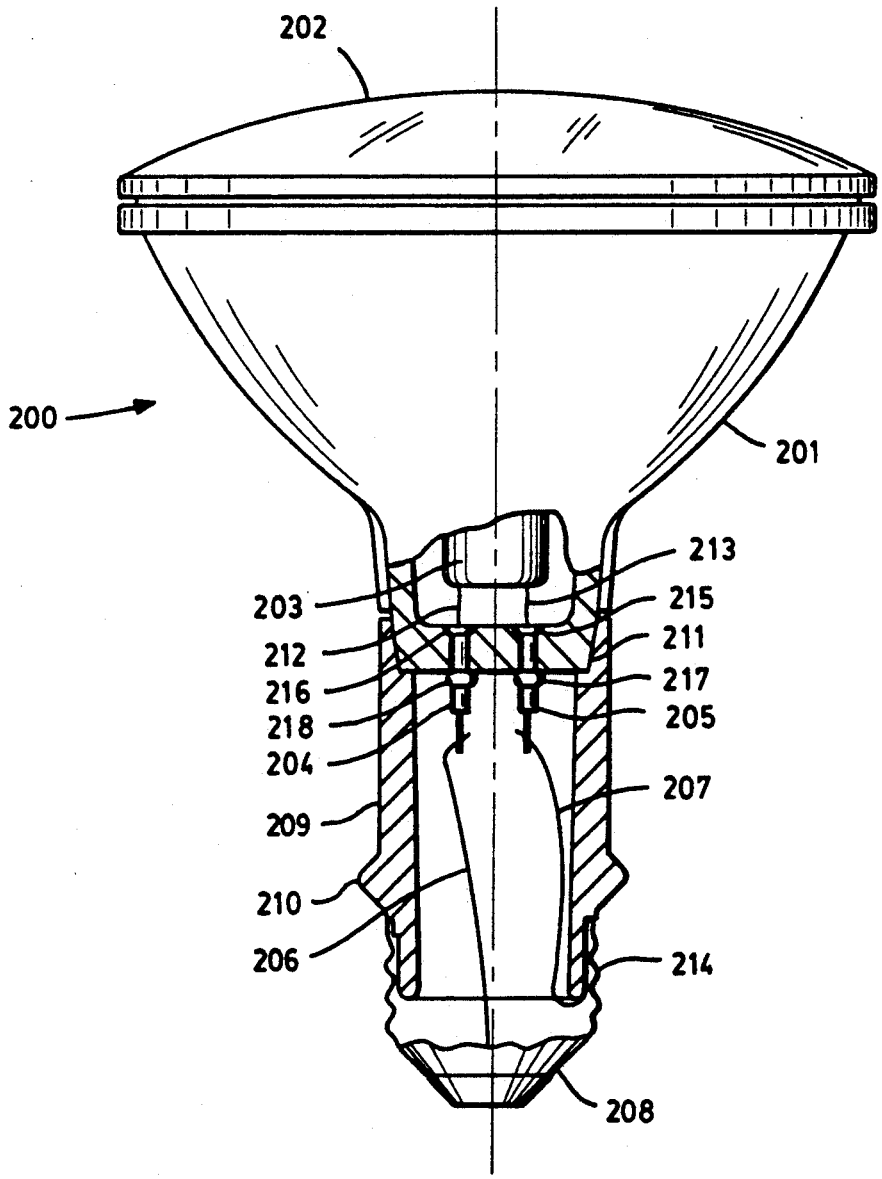
FIG. 2 is a partially cut away side view of a reflector lamp according to a first embodiment of the present invention.

A reflector lamp 200 according to a first embodiment of the present invention is illustrated in FIG. 2 and includes a lens 202, a reflector 201, a lamp capsule 203, an extender 209, and a base 208. Reflector 201 has an inside reflecting surface, typically parabolic in shape. Lens 202 can be adhesively bonded to reflector 201. Lamp capsule 203 may be any conventional lamp, including a filament lamp, a tungsten halogen lamp or an arc tube which generates light in response to AC or DC current. Lamp leads 212 and 213 extend from lamp capsule 203 through hollow, cylindrical, brass eyelets 204 and 205. The lamp leads 212 and 213 are preferably soldered, but may be welded, within brass eyelets 204 and 205. Electrical conductors 206 and 207 are soldered or welded to the ends of leads 212 and 213, respectively. Electrical conductor 206 is connected between lead 212 and the center conductor of base 208 and is either soldered or welded thereto. Electrical conductor 207 is connected between lead 213 and the outer conductor of base 208 and is welded or soldered thereto. Base 208 includes threads 214 which are adapted for engaging a lighting fixture socket. Extender 209 is disposed between and is attached to reflector 201 and base 208.

Extender 209 is generally tubular in shape and has a hollow center for receiving eyelets 204 and 205, leads 212 and 213, and electrical conductors 206 and 207. Extender 209 is molded of a high temperature resistant plastic material, such as polyphenylene sulfide, or a ceramic material, such as L3A steatite. In this embodiment, extender 209 is bonded to reflector 201 with an adhesive 211. Adhesive 211 can be a thermally cured epoxy or an inorganic cement. Base 208 is connected to extender 209 with a similar adhesive and/or dimpling.

Brass eyelets 204 and 205 extend through two holes in the bottom of reflector 201. Eyelets 204 and 205 include enlarged portions 217 and 218, respectively, which are larger in diameter than the mounting holes in reflector 201. Eyelets 204 and 205 also include expandable flanges 215 and 216, respectively, at the top ends thereof which rest in counterbores in reflector 201. During manufacture, the top portions of eyelets 204 and 205 are not flared initially. The eyelets are inserted into the holes in reflector 201 from the bottom side until the enlarged portions contact the reflector 201. Then flanges 215 and 216 are spread so that they are incapable of passing through the reflector holes and rest within the counterbores in the reflector 201. As a result, eyelets 204 and 205 are securely mounted in reflector 201.

Figure 3:
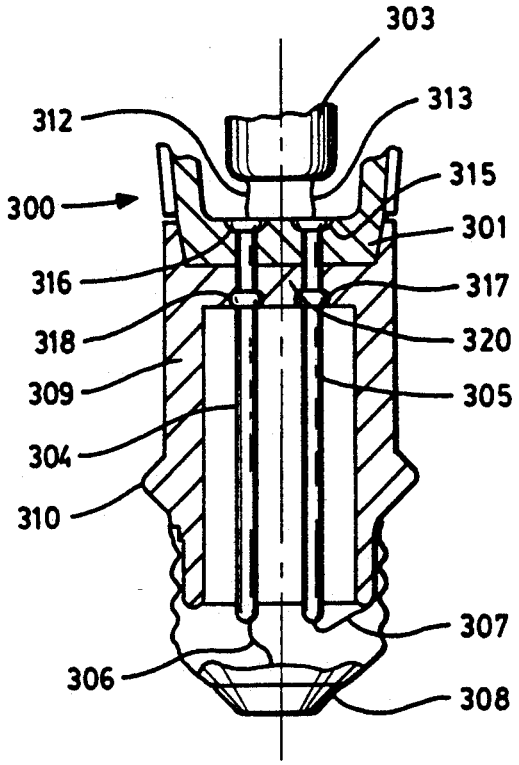
FIG. 3 is a cross-sectional side view of a reflector lamp neck region according to a second embodiment of the present invention.

A second, preferred embodiment of the present invention is shown in FIG. 3. In this embodiment, eyelets 304 and 305 connect an extender 309 to a reflector 301. In this embodiment, eyelets 304 and 305 extend the full length of the extender 309. Leads 312 and 313 are soldered to the top of eyelets 304 and 305, and electrical wires 306 and 307 are soldered or welded to the base end of eyelets 304 and 305, respectively. During manufacture, the relatively long eyelets 304 and 305 are easily accessible from the base end of extender 309 before attachment of base 308. Therefore, electrical wires 306 and 307 are easily soldered or welded to the base end of the eyelets. It is envisioned, alternatively, that leads 312 and 313 may run through the full length of eyelets 304 and 305 with electrical wires 306 and 307 soldered or welded to leads 312 and 313 respectively, at the base end of the eyelets. Extender 309 further includes a closed end portion 320 having holes therethrough for receiving the eyelets.

As illustrated in FIG. 3, eyelets 304 and 305 extend through holes in the end portion 320 of extender 309 and holes in the bottom of the reflector 301. Upper expandable flanges 315 and 316 (when flared out) rest within counterbores in reflector 301, thereby preventing the eyelets from passing through the holes in reflector 301. Enlarged portions 317 and 318 of eyelets 304 and 305, respectively, rest in recesses in end portion 320 of extender 309. These enlarged portions 317 and 318 prevent eyelets 304 and 305 from passing through the holes in end portion 320 of extender piece 309. In this manner, extender 309 is secured to reflector 301.

During manufacture, flanges 315 and 316 are initially not flared, and eyelets 304 and 305 are inserted from the underside of extender 309 through the holes in end portion 320 of extender 309 and reflector 301 until portions 317 and 318 contact extender 309. Then flanges 315 and 316 are flared out into contact with reflector 301 and rest within the reflector counterbores, thereby securing reflector 301 to extender 309.

In a preferred embodiment of the present invention, the reflector lamp is 3 ¾" in diameter. A preferred embodiment extender increases the length of the neck by approximately 1 5/16". It is to be appreciated, however, that any length extender may be utilized for extending the length of the lamp as desired.

Also illustrated in FIGS. 2 and 3 are external annular ribs 210 and 310, formed in extenders 209 and 309, respectively. The purpose of the ribs 210 and 310 is to meet IEC safety and dimensional requirements.

The present invention provides a reflector lamp which fits into recessed lighting fixtures without requiring the use of a modular extender and without requiring major costs associated with manufacturing, including tooling, assembly and parts costs. In addition, the extender thermally isolates the lamp base from the lamp filament. Thus, the base can operate at a relatively low temperature, which permits the use of lower temperature components, including the base solder. An unleaded solder, which generally operates at reduced temperatures, may be used as the base solder.

While there have been shown and described what are at present considered the preferred embodiments of the invention, it will be obvious to those skilled in the art that various changes and modification may be made therein without departing from the scope of the invention as defined by the appended claims.

What is claimed is:

1. A reflector lamp suitable for use in a lighting fixture, said reflector lamp comprising:

a lens;

a reflector attached to said lens having a neck;

a threaded base for connection to a lamp socket of a lighting fixture and adapted to receive electrical energy and having a longitudinal length;

means, internal to said reflector and electrically connected to said base, for generating light in response to said electrical energy, said means for generating light comprising a lamp capsule; and extender means, connected between the reflector and the threaded base, for extending the neck of the reflector, said extender means comprising a single electrical insulating member having a first end attached to said threaded base, a second end having a collar surround a portion of said neck of said reflector and directly and non-detachably connected to the neck of said reflector whereby said neck of said reflector and said threaded base are longitudinally separated a predetermined distance.

2. A reflector lamp as set forth in claim 1 wherein said extender means is fabricated of a high temperature resistant plastic material.

3. A reflector lamp as set forth in claim 2 wherein said high temperature resistant plastic material includes polyphenylene sulfide.

4. A reflector lamp as set forth in claim 2 wherein said high temperature resistant plastic material includes a ceramic material.

5. A reflector lamp as set forth in claim 2 wherein the extender means is attached to the base by an adhesive material.

6. A reflector lamp as set forth in claim 2 wherein the extender means is attached to the reflector by an adhesive material.

7. A reflector lamp as set forth in claim 6 wherein said adhesive material includes a thermally cured epoxy.

8. A reflector lamp as set forth in claim 6 wherein said adhesive material includes an inorganic cement.

9. A reflector lamp as set forth in claim 2 wherein said extender means is tubular in shape.

10. A reflector lamp as set forth in claim 9 wherein the extender means has an end wall which is secured to the reflector.

11. A reflector lamp as set forth in claim 10 wherein the end wall is secured to the reflector with eyelets.

12. A reflector lamp as set forth in claim 1 wherein said predetermined distance longitudinally separating said neck of said reflector and said threaded base is greater than said longitudinal length of said threaded base.

13. A reflector lamp as set forth in claim 1 wherein said extender means includes an external annular rib.

* * * * *